United States Patent [19]

Billion

[11] Patent Number: 4,723,659

[45] Date of Patent: Feb. 9, 1988

[54] APPARATUS FOR DETECTING IMPURITIES IN TRANSLUCENT BODIES

[75] Inventor: Leo Billion, Erps Kwerps, Belgium

[73] Assignee: Supernova Systems, Inc., Sioux Falls, S. Dak.

[21] Appl. No.: 838,946

[22] Filed: Mar. 12, 1986

Related U.S. Application Data

[63] Continuation-in-part of Ser. No. 750,872, Jun. 28, 1985, Pat. No. 4,634,881.

[51] Int. Cl.[4] ..... B07G 5/342

[52] U.S. Cl. ..... 209/576; 209/559; 209/585; 356/237; 250/563

[58] Field of Search ..... 209/552, 559, 576, 577, 209/578, 579, 585, 587, 588; 356/434, 237; 250/563, 223, 572

[56] References Cited

U.S. PATENT DOCUMENTS

| | | | |
|---|---|---|---|
| 3,198,951 | 8/1965 | Lentze | 250/563 |
| 3,230,305 | 1/1966 | Kendrick | 250/563 |
| 3,521,074 | 7/1970 | Frobese | 250/563 |
| 3,909,602 | 9/1975 | Micka | 250/572 X |
| 4,455,086 | 6/1984 | West et al. | 250/572 X |
| 4,464,050 | 8/1984 | Kato et al. | 250/572 X |
| 4,532,723 | 8/1985 | Kellie et al. | 209/579 X |

FOREIGN PATENT DOCUMENTS

| | | | |
|---|---|---|---|
| 57-113354 | 7/1982 | Japan | 250/563 |

*Primary Examiner*—Robert B. Reeves

*Assistant Examiner*—Glenn B. Foster

*Attorney, Agent, or Firm*—Alan H. Levine

[57] ABSTRACT

An apparatus including a source for producing a concentrated light beam, such as a laser, a background element spaced from the source against which the light beam is directed, and a transport arrangement for moving translucent bodies, such as French cut potatoes, through the light beam. When light from the source impinges upon a pure translucent body, the light is scattered or diffused within the body around the point of impingement so as to illuminate a surface area of the body larger than the cross-sectional area of the light beam, but light from the source impinging upon an impurity in the translucent body is scattered or diffused to a lesser extent. The background element is formed of a material which causes light from the source which impinges on it to be diffused within the material in a manner similar to the diffusion of the light in the translucent bodies. A receiver having a field of view larger than the cross-sectional area of the light beam receives light reflected from the background and from translucent bodies moving through the light beam. The receiver is insensitive to light in the part of its field of view which is operatively aligned with the point of impingement of the light beam on the translucent bodies or on the background element. The receiver produces an output signal which changes when an impurity enters the concentrated light beam, and this changed signal is used to operate a device which removes the impurity from the remainder of the translucent bodies.

9 Claims, 6 Drawing Figures

APPARATUS FOR DETECTING IMPURITIES IN TRANSLUCENT BODIES

This application is a continuation-in-part of copending application Ser. No. 750,872, filed June 28, 1985.

This invention relates to detecting impurities in translucent bodies, and removing from a mass of such bodies those in which impurities are detected.

The invention finds utility in detecting impurities, i.e., relatively opaque discolorations, in French cut potatoes, i.e., raw potatoes cut into strips which after being deep fried become French fried potatoes. Therefore, although the invention has other applications as well, it will be described with reference to French cut potatoes.

It is an object of the present invention to provide an apparatus for detecting impurities in translucent bodies, e.g., French cut potatoes, which permits high speed scanning of the individual potato strips, is extremely accurate, enabling detection of even small impurities, and does not require a high level of ambient light.

The invention is predicated on a realization that when a concentrated light beam impinges upon a French cut potato strip, the light diffuses into the translucent potato so that the surface area of the potato which is illuminated is considerably larger than the diameter of the incident light beam. For example, a 2 mm helium-neon laser beam directed at a potato strip illuminates a surface area of the strip ten to thirty times larger than the diameter of the laser beam; the potato strip has the appearance of a miniature fluorescent lamp. However, when the concentrated light beam impinges upon a defect or impurity in the potato strip, which is opaque, or much less translucent than the pure potato material, there is very little or no diffusion of the light into the potato. As a result, the illuminated area of the potato is about equal to the diameter of the light beam, i.e., the illuminated area is much smaller than when the light beam strikes a pure region of the potato strip.

With this difference in illuminated area in mind, it was realized that if a sensing means is arranged to receive light reflected from an area of the potato strip considerably larger than the diameter of the incident light beam, the sensing means can detect a drop in the reflected light received when an impurity in the potato enters the light beam. This decrease in received light can be used to signal the presence of an impurity which should be removed. Moreover, the sensitivity of the sensing means, to detection of the drop in reflected light, is increased by making the sensing means "blind" at its center, i.e., insensitive to light in the part of its field of view operatively aligned with the point of impingement of the light beam on the translucent bodies or on the background element.

The invention is based upon an understanding that advantageous use can be made of the fact that impact of a concentrated light beam, such as a laser beam, upon some materials, including various fibrous and cellulose substances, will cause a light scattering effect. The impact of the concentrated light beam causes an intense light spot, having a size equal to the cross-sectional area of the beam, caused by diffuse reflection on the material's surface at the point where the beam strikes, and also around the intense light spot, in a circular zone, a less intense illumination, the intensity of which gradually decreases from the center outwards. If the beam, however, touches an impurity or irregularity in the fibrous structure, e.g., a black spot, this scattering phenomenon disappears completely.

This invention thus is characterized by the fact that the detection of impurities is obtained by measuring the intensity of only that part of the reflected light which is a result of the scattering, around the point of light beam impact. The photosensitive receiver is made blind in the part of its field of view corresponding to the beam impact spot itself.

By making the photosensitive detector blind at the center of the reflected image, the influence of the diffuse reflected light from the concentrated light beam at the point of incidence is eliminated. Thus, although the intense light spot at the point of incidence of the concentrated light beam is indeed projected toward the center of the detector, such projection has no influence on the output signal of the photosensitive detector, e.g., a photomultiplier tube.

The clearly illuminated zone around this spot, however, results in a certain intensity of light and therefore in a certain output signal of the light sensitive detector. The signal fully disappears when the scanning beam touches a dark spot on or in the product being inspected.

It is another object of the present invention to provide an apparatus for detecting impurities in translucent bodies wherein the intensity of reflected light from a body changes appreciably when an impurity enters the concentrated light beam, but does not change, or changes only minimally, when the edges of the body enter and leave the light beam.

In this connection, use is made of a background in the sorting zone made from a material that also spreads the incident light beam by internal scattering underneath its surface. By doing this, transitional signals that may occur when the scanning beam strikes the edges of the objects to be inspected are almost completely eliminated.

The term "scattering" is used herein in the sense defined in Webster's Third New International Dictionary: "to diffuse or disperse (a beam of radiation) in a random manner as a result of collision of the particles, photons, or waves with particles of the medium traversed".

The apparatus according to this invention can also successfully be used for detection of irregularities among conveyable objects being conveyed, e.g., for detection of white stones among blanched navy beans (white beans). Blanched beans do present the above-described scatter properties, while little stones do not. This permits sorting out foreign objects from among navy beans at high speed and very efficiently.

In one preferred embodiment of the invention, a second photosensitive detector is used to receive that part of the reflected light which was directed to the insensitive zone of the first detector. This combination provides a simple means for choosing scatter reflection or diffuse reflection in carrying out specific sorting requirements. The second photosensitive detector receives the diffuse reflected light from the scanning beam on the point of incidence and the first photosensitive detector receives, via a mirror, the reflected scatter-light. Selection of the detection mode may be made simply by switching the selected signal processing circuit to the detector.

One preferred solution for separating the two sorts of reflected light is to obtain a picture of the illuminated product by using a focusing means which focuses the reflected image upon a mirror having a small hole at the center, behind which hole the second photosensitive detector is installed while the first photosensitive detector only receives the light reflected by this mirror less its hole.

Additional objects and advantages of the present invention will be apparent from the following description in which reference is made to the accompanying drawings.

IN THE DRAWINGS

FIG. 1 is a schematic illustration of an apparatus, according to the invention, for detecting impurities in French cut potatoes, and for removing the impurities therefrom;

FIG. 3 illustrates the phenomenon, which according to the invention is used for sorting;

Figure 2:
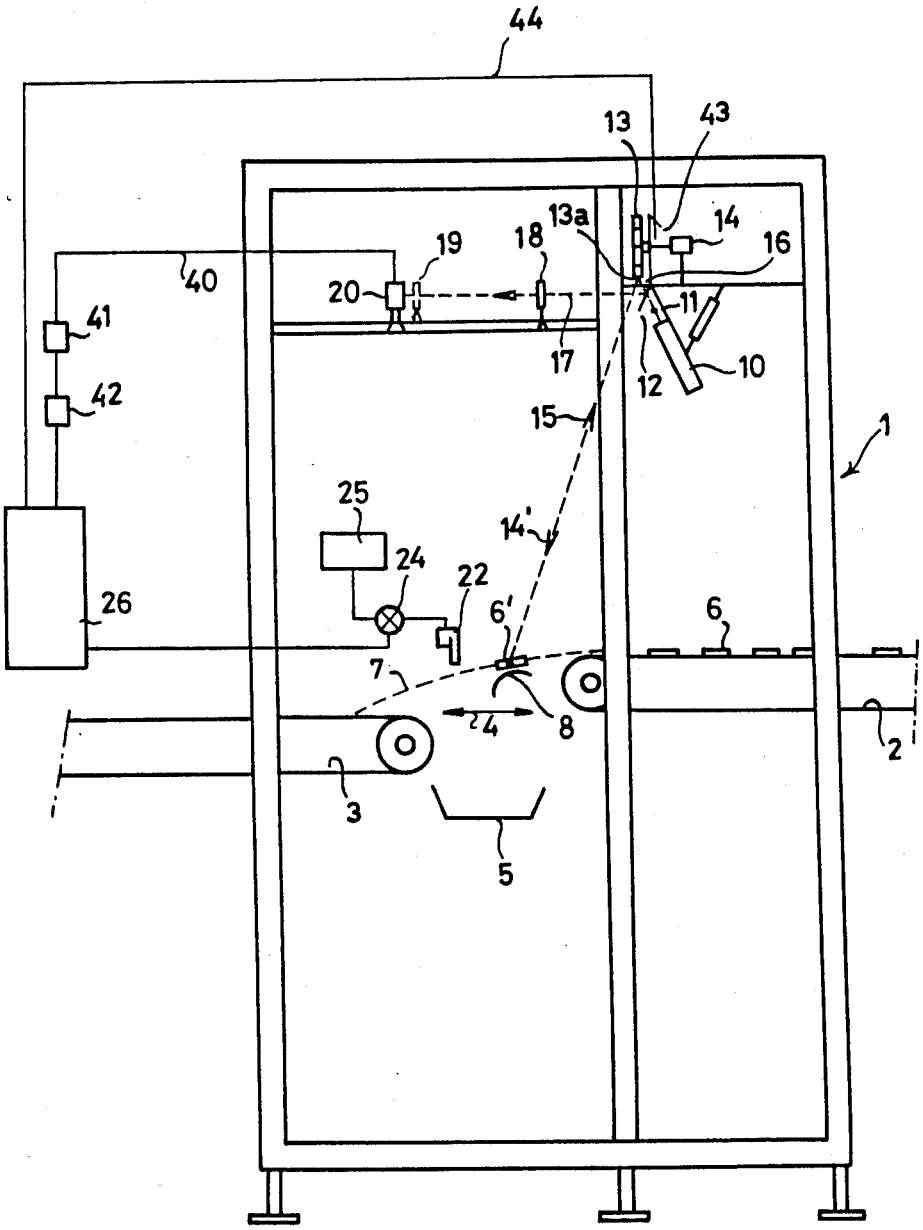
FIG. 2 is a top view of a part of this apparatus.

The apparatus chosen to illustrate the present invention, and illustrated in FIG. 1, includes a conveyor 2, for transporting French cut potato strips 6 toward an inspection zone 4, and another conveyor 3 for delivering the potato strips which reach it for further processing, such as freezing and packaging. The conveyors and other components of the apparatus are supported by a framework 1. Between the 2 conveyors is the sorting area 4 and underneath is a chute 5 for evacuating the rejected product and/or rejected impurities.

The objects to be sorted, e.g., French cut potatoes, cross the sorting zone 4 in free flight because conveyor 2 moves at high enough speed so that, as the potato strips leave the forward end of the conveyor, they are tossed through the air along trajectories indicated by broken line 7 and onto conveyor 3.

Underneath the trajectories 7 followed by the potato strips 6 in the sorting zone 4, a background element 8 is mounted. The background element is made of a substance having the property of dispersing, by scattering, a small incident concentrated light beam in such a way that around the highly illuminated spot, where the incident beam strikes the surface, another well illuminated area is created, the so called scatter effect.

When the objects to be sorted follow trajectory 7, they are illuminated while in the trajectory by a very fast scanning, highly concentrated lightbeam. The scanning lightbeam is produced by a stationary laser unit 10, mounted on the frame 1, the beam 11, emerging from the laser, striking one of the mirrors 13*a* of the multifaceted polygon shaped mirror 13 after passing through an opening in a mirror 12. The polygon mirror is mounted on the shaft of an electric motor 14 which rotates the mirror at high speed. Therefore the beam reflected by a mirror 13, along the path 14', "scans" the full width of sorting zone 4 forming a detection plane above the background 8. All product tossed from infeed conveyor 2 towards output conveyor 3 will cross this detection plane.

As described below, this illumination results in a return beam 15 which also strikes the multifaceted mirror 13 and then is reflected in a direction as indicated by arrowhead 16 on to the mirror 12 which reflects the beam in the direction indicated by arrowhead 17. Via a focusing lens 18 the returning light then reaches the photosensitive detector 20, e.g., a photomultiplier, possibly via polarising filter 19, which results in a certain output signal of the detector, a signal which is a function of the quantity of returning light.

Above the trajectory 7 of the objects to be sorted, a plurality 22 of individual air jets 23 is mounted, each one being connected with an air valve 24 and with an air pressure unit 25. The air valves 24 are individually operated from a central processing unit 26 which will be described later on.

A basic principle of the present invention is illustrated in FIG. 3. As mentioned before, there are materials such as various synthetics (polyamides) and also natural products such as potatoes, pears, carrots, apricots, and blanched beans, which under a concentrated lightbeam, will disperse light underneath their surface in all directions so that around the place where the beam touches the surface an enlarged circular light zone occurs.

FIG. 3 shows a part of a background element 8 made of, e.g., polyamide, polyethylene, and polyacetate. An incident lightbeam striking the background will result in a highly intensive light spot 30 surrounded by a less intensive circular light spot 31. When the scanning lightbeam 32 which produces the intensive light spot reaches a scattering object, e.g., a potato strip 33, then on the surface of the potato strip a high intensity light spot 34 appears surrounded by a circular light zone 35.

Figure 4:
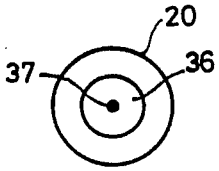
FIG. 4 is a front view of the photosensitive detector used in the apparatus according to the invention.
Figure 2:
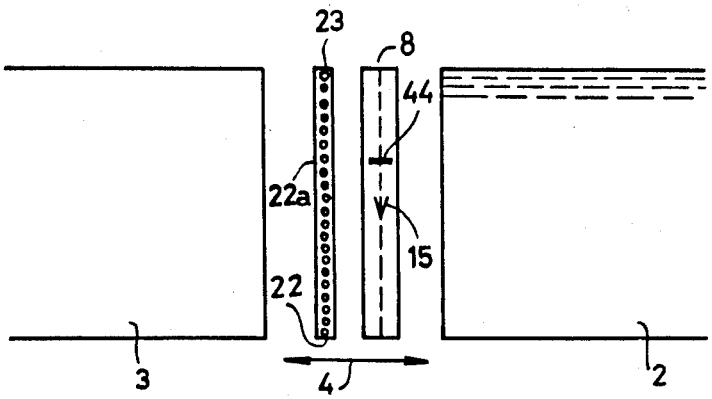

Via the optics described above, this combination of the central light spot and the surrounding circular light zone is projected on to the surface of a photosensitive detector 20, as shown in FIG. 4, as a circular lightzone 36. According to the invention, the optical centerpoint of the photosensitive detector has been made blind by means of a small black spot 37 so that the light spot 30 or 34 caused by diffuse reflection, has no influence on the output signal of the photosensitive detector. This effect can naturally also be obtained in a different, e.g., an optical way.

When the scanning beam strikes a pure part of the French cut potato, the output signal of the photosensitive detector will not or only slightly change. When, however, the scanning beam, along line 32*a* in FIG. 3, passes on to an impurity 39 or a defect in a French cut potato strip 33, this will cause a substantial reduction of the light intensity of illuminated zone 31, resulting in a large change in the output signal of detector 20.

The output signal of detector 20 is sent along line 40 (FIG. 1), via a pulse shaping network 41 and a threshold circuit 42, to the central processing unit 26 which will produce an output signal indicating when, in the product being inspected, an irregularity has been detected. The rotating mirror 13 is combined with a position detector 43 passing information along line 44 to the central processing unit 27 concerning the exact position at any moment in time of the mirror facet 13*a* which is illuminated at that moment. This information is directly representative of the momentary position of the scanbeam in the detection zone. A suitable process circuitry commands the operation of the appropriate air jet 23 located at the exact place where the detected impurity will pass by.

Let us assume that in the inspection station 4 a French cut potato containing a defect traverses the plane defined by moving beam 14'. The process control unit, at the moment it receives the detection signal, "gathers" (from the instant of time being referred to the angular position of mirror 13*a*) the exact position of the detected impurity and energizes, via the appropriate air valve, the air jet unit 22 located just above the impurity's trajectory. The French fry is then deviated from its normal flying curve 7 and blown down into the reject chute 5.

Figure 5:
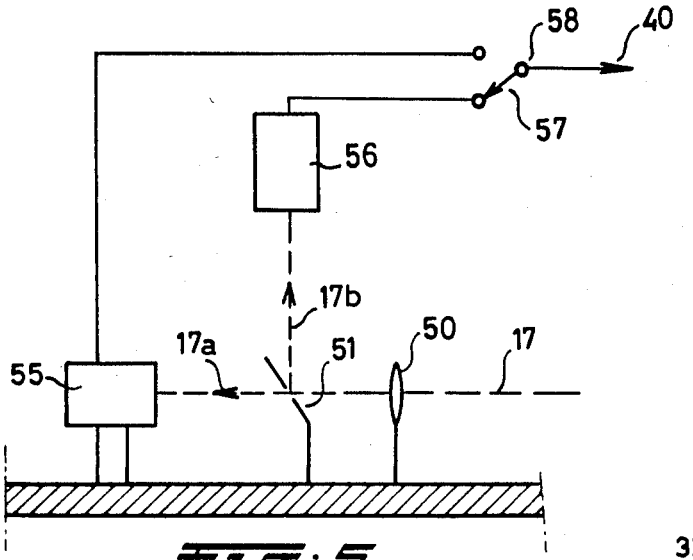
FIG. 5 is a schematic side view of another version of the photosensitive detection system.
Figure 5:
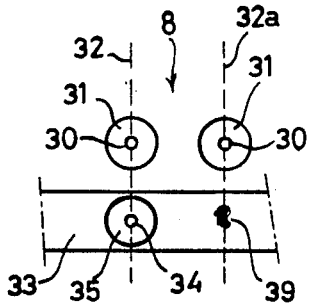
Figure 6:
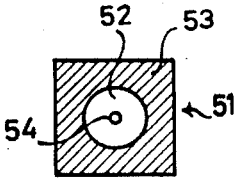
FIG. 6 is a front view of the semi-transparent mirror used in the version of FIG. 5.

This invention has been shown and described in preferred form only, and by way of example, and many variations are possible within the invention which will still be comprised within its spirit. For example, FIG. 5 illustrates a variant showing the reflected beam 17 being focused by lens 50 on to mirror 51, a front view of which is shown in FIG. 6. As shown in FIG. 6, mirror 51 comprises a circular mirroring or reflective part 52 surrounded by a non-reflective part 53 and further comprises a narrow central opening 54 adjusted to coincide with the image of the point of incidence of the scanning beam.

A part 17*a* of the returning light beam which reaches mirror 51 will pass through the central opening 54 and reach a photosensitive detector 55. The other part, beam 17*b*, will reach a second photosensitive detector 56. Diffuse reflection on a surface results only in a single light spot which will be reflected only on to photosensitive detector 55. Scatter reflection, however, results in an illuminated zone which will be reflected on to photosensitive detector 56. The respective outputs of both detectors are connected to selector switch 57, the output of the latter being line 40. This allows easy switching of the apparatus from sorting according to diffuse reflection to sorting by using the scattering principle. For certain sorting requirements, both detection principles may have to be used simultaneously.

I claim:

1. An apparatus for detecting impurities in translucent bodies, comprising:

(a) a source for producing a concentrated light beam, the light beam having a relatively small cross-sectional area, (b) means for causing the concentrated light beam to repeatedly scan along a path, (c) transport means for moving a plurality of rows of translucent bodies simultaneously through the light beam path in a direction transverse to the path, light from the source impinging upon a pure translucent body being diffused within the body around the point of impingement so as to illuminate a surface area of the body larger than the cross-sectional area of the light beam, but light from the source impinging upon an impurity in the translucent body being diffused to a lesser extent, (d) a background element against which the light beam is directed, the background element being located so that the path of movement of the translucent bodies is between the light source and the background element, and the background element being of a material which causes light from the source which impinges on it to be diffused within the material in a manner similar to the diffusion of the light in the translucent bodies, (e) a photosensitive detector for receiving light from the translucent bodies, the detector having a field of view much larger than the cross-sectional area of the light beam, and (f) means for making the detector insensitive to light in the part of its field of view which is operatively aligned with the point of impingement of the light beam on the translucent bodies or on the background element, so that the detector receives less light when the beam impinges upon an impurity than when the beam impinges upon the translucent body without impurities or upon the background element, and the detector producing a signal proportional to the intensity of the light it receives.

2. An apparatus as defined in claim 1 wherein the means for making the receiving means insensitive to light includes a black spot located at the center of the photosensitive detector.

3. An apparatus as defined in claim 1 wherein the background element is formed of a translucent plastic material.

4. An apparatus as defined in claim 3 wherein the plastic material is selected from the group consisting of polyamide, polyethylene, and polyacetate.

5. An apparatus as defined in claim 1 including a mirror operatively interposed between the concentrated light beam source and the background, the light beam passing through an opening in the mirror, the mirror being arranged to reflect light, from the background and from translucent bodies passing through the beam, to the receiving means.

6. An apparatus as defined in claim 1 wherein the scanning means includes a multifaceted mirror, and means for rapidly rotating the mirror to sequentially bring each facet into the concentrated light beam.

7. An apparatus as defined in claim 6 including a planar mirror operatively interposed between the multifaceted mirror and the receiving means, so that each facet, at the time it reflects the concentrated light beam toward the background also reflects light from the background toward the photosensitive detector via the planar mirror.

8. An apparatus as defined in claim 1 including a second photosensitive detector for receiving the light from the translucent bodies which would otherwise be received by the insensitive part of the first-mentioned photosensitive detector.

9. An apparatus as defined in claim 8 including a mirror for reflecting light from the translucent bodies to the first detector, the mirror having an opening through which light from the translucent bodies passes to the second detector.

* * * * *